United States Patent [19]

Barber et al.

[11] 4,119,377

[45] Oct. 10, 1978

[54] SELF-ALIGNING DRAWER SLIDE TAB

[75] Inventors: Lloyd L. Barber, Santa Ana; Alan J. Koppelman, Studio City, both of Calif.

[73] Assignee: Standard Precision, Inc., Santa Fe Springs, Calif.

[21] Appl. No.: 705,824

[22] Filed: Jul. 16, 1976

[51] Int. Cl.[2] ..... A47B 88/10

[52] U.S. Cl. ..... 312/344; 308/3.6; 312/341 R; 312/347

[58] Field of Search ..... 312/347, 348, 341 R, 312/350, 346, 344; 308/3.6, 3.8, 3.9

[56] References Cited

U.S. PATENT DOCUMENTS

| | | | |
|---|---|---|---|
| 3,328,106 | 6/1967 | Mullin | 308/3.6 |
| 3,387,907 | 6/1968 | Wall | 312/341 |
| 3,574,437 | 4/1971 | Stein | 308/3.8 |
| 3,981,553 | 9/1976 | Gutner | 308/3.6 |

*Primary Examiner*—Paul H. Gilliam
*Assistant Examiner*—Alex Grosz
*Attorney, Agent, or Firm*—J. C. Baisch

[57] ABSTRACT

A drawer slide having a pair of parallel slide members, one of the slide members having a roller at the end opposite the roller of the one member.

The slide members are channel-shaped and oppositely arranged, with the roller of one slide member received in the channel of the other slide member, the rollers carrying each respective slide member. A resilient tab is lanced out of one of the slide members adjacent an end. When the slides are installed in a drawer or cabinet, one slide member is attached to the side of a drawer while the other slide member is attached to an adjacent part of the desk or cabinet drawer opening. The tab is turned inwardly of the slide member opposite the slide member having a roller at that end. The free end of the tab is at the free end of the slide member from which it is lanced out; and, when the slide members are retracted, the tab frictionally and yieldingly engages a part of the adjacent roller to take up any play between the two slide members. This also causes frictional engagement to releasably restrain longitudinal extended movement of the slide members. There are slides at each side of the drawer and the tabs are at the front end of the drawer, and together take up any play between the drawer and the cabinet as well as any play between the slide members.

1 Claim, 6 Drawing Figures

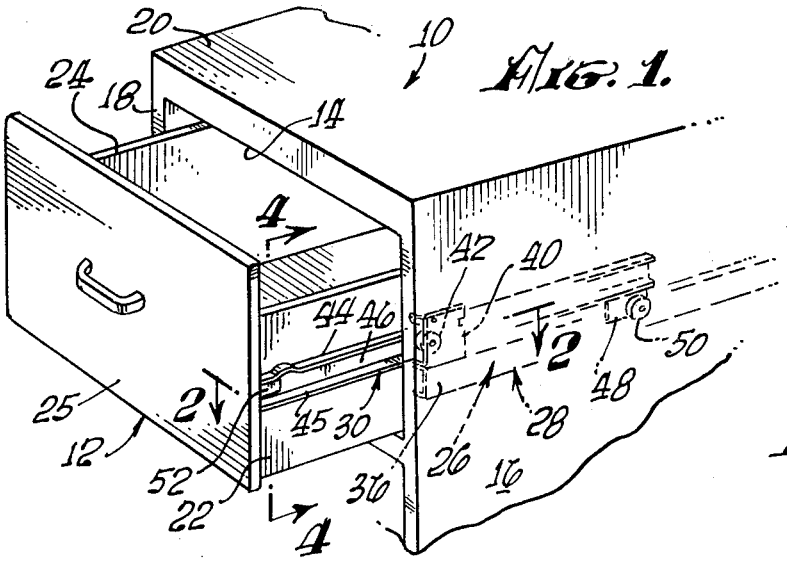
FIG. 1.
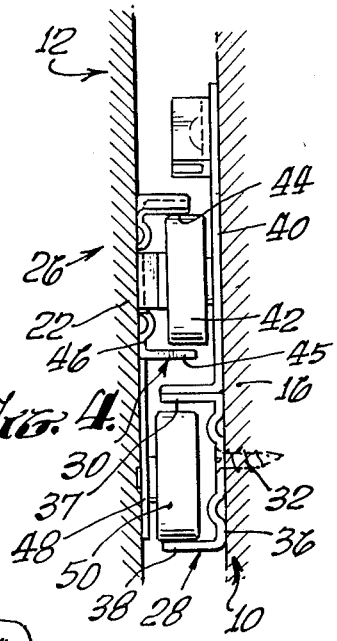
FIG. 4.
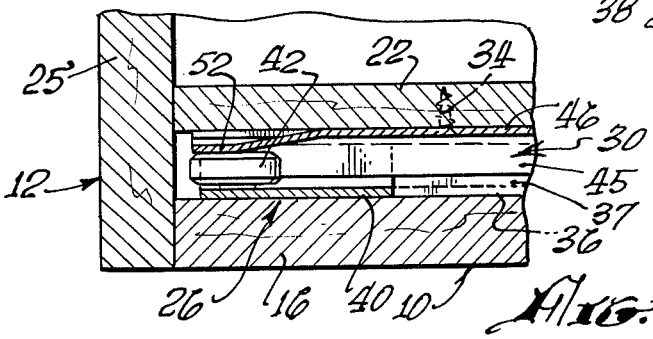
FIG. 2.
FIG. 3.
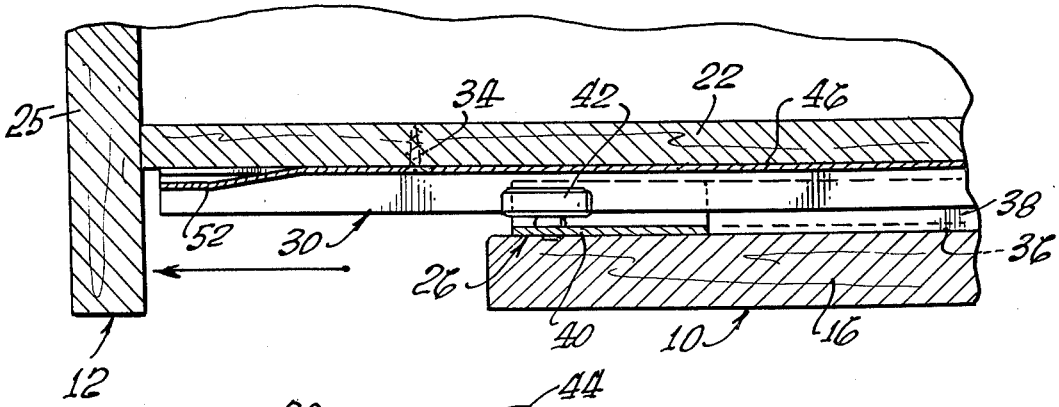
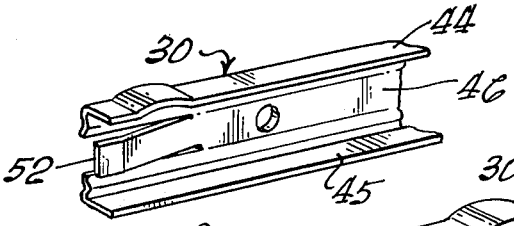
FIG. 5.
FIG. 6.
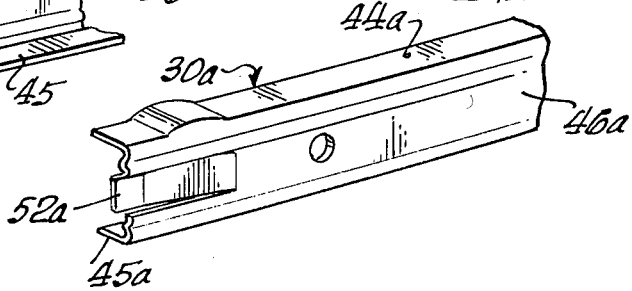

SELF-ALIGNING DRAWER SLIDE TAB

BACKGROUND OF THE INVENTION

1. Field of the Invention

This invention relates to a drawer slide mechanism generally associated with desks and cabinets and, more particularly, to a drawer slide having a self-aligning device whereby the slides are held to prevent lateral movement when in a closed mode, and a means to adjust the lateral position of the drawer so that all drawers will be aligned when closed.

2. Description of the Prior Art

At the present time there is a great variety of drawer slide mechanisms, each being designed to be employed under many different conditions. Generally, however, these units do not provide a means to prevent lateral movement of the drawers with the side walls of the cabinets, particularly when the drawers are positioned in a fully closed condition. Unless a slide mechanism is precisely made with controlled tolerances, play between the slide channels and rollers will be inherent therein. Thus, a means to remove the play between the slide channels; rollers in the closed position as well as providing a horizontal positioning means to align each drawer to the cabinet and each other drawer is desirable.

SUMMARY OF THE INVENTION

The present invention comprises a slide mechanism which is incorporated for use with drawers associated with cabinets, desks and files having a pair of slide members juxtapositioned in parallel relation to each other. Each slide member includes a roller wherein the roller of the first slide member is positioned at the opposite end of the roller that is secured to the second slide member. The slide members are channel-shaped and oppositely disposed so as to receive the respective rollers therein.

As is well known, one channel slide member is secured to the side of the drawer while the oppositely disposed channel slide is secured to the inner side wall of the cabinet or file.

With respect to the drawer-mounted slide, the slide is provided at its forward free end with a resilient tab formed from the channel wall of the slide, the tab being bent inwardly so as to frictionally engage the roller of the opposite slide member when the drawer is completely closed. Hence, the slide members are at this time retracted; and the tab frictionally and yieldingly engages a part of the adjacent roller, thereby taking up any play between the two slide members.

With the inclusion of a second sliding unit mounted to the opposite side of the drawer, it can be seen that lateral movement of the drawer is also prevented. The frictional engagement of the tabs with their respective rollers causes a releasable, restrained, longitudinal, extended movement of the slide members. Thus it can be seen that the individual tabs can be manually adjusted to position the drawer horizontally within the cabinet, providing a lateral adjustment for drawer alignment within the cabinet.

OBJECTS AND ADVANTAGES OF THE INVENTION

It is, therefore, an important object of the invention to provide a self-aligning drawer slide mechanism having frictional engaging tabs to prevent unrestrained movement of the slides and drawer thereof.

Another object of the present invention is to provide a self-aligning drawer slide device wherein at least one slide member thereof includes a resilient tab arranged to releasably engage the roller of the opposite slide member, to prevent both longitudinal and lateral movement.

It is still another object of the invention to provide means of this character which will eliminate the lateral movement of the associated drawer, and automatically align the drawer within the cabinet or file opening.

It is a further object of the invention to provide a device of this character that will provide a means to adjust the lateral position of drawer fronts such that the drawer edges will be in line when the drawers are closed.

A still further object of the invention is to provide a device of this character having a greatly improved operation, with the slide having relatively few operating parts.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the accompanying drawings, which are for illustrative purposes only:

FIG. 1 is a perspective view of a portion of a cabinet, showing a partly opened drawer and a slide embodying the present invention;

FIG. 2 is an enlarged cross-sectional view taken substantially along line 2—2 of FIG. 1 showing the resilient tab disengaged from the foller;

FIG. 3 is a cross-sectional view showing the resilient tab in frictional engagement with the roller of the opposite slide member;

FIG. 4 is a cross-sectional view taken along line 4—4 of FIG. 1;

FIG. 5 is a partial perspective view of one slide member and its related tab; and FIG. 6 is a partial perspective view of the oppositely arranged slide member.

DESCRIPTION OF THE PREFERRED EMBODIMENT

Referring to FIG. 1, there is shown a cabinet or desk, generally indicated at 10, having a drawer 12 slidably mounted and received in opening 14 of the cabinet 10. The opening 14 is defined by side walls 16 and 18, and top member 20 of the cabinet 10. Said drawer 12 comprises the usual side walls 22 and 24, and front wall 25, the side walls 22 and 24 being positioned in the normal adjacent manner to the respective side walls 16 and 18 of the cabinet, wherein the space formed between the adjacent walls allows the slide mechanisms, indicated generally at 26, to be operably mounted therebetween.

The slide mechanism comprises a pair of parallel slide members juxtapositioned so as to be arranged wherein the first slide member, generally designated at 28, is positioned above the second slide member generally designated at 30. Said first slide member 28 is shown secured to the inner surface of wall 16. The means for securing said slide member 28 can be by any well known manner; and is herein shown being secured by screw 32, seen in FIG. 4.

Slide member 30 is illustrated as being mounted to the outer surface of side wall 22 of the drawer 12. A mounting screw 34 is also shown in FIGS. 2 and 3.

It should be readily understood that a slide mechanism as herein shown and indicated at 26 is also provided between wall 18 of the cabinet 10 and wall 24 of the drawer 12. Therefore, the detailed description of one slide mechanism will suffice for both units.

Slide member 28 comprises an elongated channel-shaped rail having a back wall 36 and inwardly turned upper and lower flanges 37 and 38, respectively, there being a an upwardly extending leg member 40 affixed to the upper or top side of flange 37 which is located adjacent the forward free end of the slide member 30. Rotatably mounted to side leg member is a roller 42, said roller being arranged above the side member 28 so as to freely receive the channel-shaped second slide member 30 which is generally attached to the drawer, as shown in the various views thereof.

The channel-shaped second slide member 30 also includes inwardly bent upper and lower flanges 44 and 45, respectively, said flanges being formed throughout the full length of each slide member.

Accordingly, the flanges 44 and 45 are integrally formed from the back wall 46. Fixedly secured to the upper flange 44 is a downwardly extending leg member 48, which provides a mounting bracket for roller 50, said leg 48 and roller 50 being located rearwardly of the forward free end of slide member 30 and arranged to be received in the oppositely disposed slide member 28, wherein the roller 50 is supported by lower flange 38 thereof. Thus, roller 42 when received in slide 30 rests on lower flange 45 thereof.

However, it can be seen that such an arrangement allows for a loose fit between the rollers and slide members — the slide members with respect to each other and the drawer with respect to the cabinet. Therefore, there is herewith included a means to provide frictional engagement between the side members to take up any play therebetween, particularly when the drawer is in a fully closed mode as seen in FIG. 3. Hence, the tabs provide a self-aligning drawer means.

In the arrangement of the parts as herein illustrated, slide member 30 includes said frictional means which comprises a lanced tab or finger member 52 formed at the free forward end of slide member 30. This tab is stamped from back wall 46 and bent inwardly therefrom, providing a resilient member to directly engage roller 42 of slide member 28 when the drawer is brought to a closed position. When in this position as seen in FIG. 3, the resilient tab 52 forceably engages roller 42, thereby taking up slack movement of the slides and drawer. However, it must be kept in mind that the opposite side of the drawer 12 is also being frictionally held in place. Thus, lateral movement of the drawer is prevented thereby and the longitudinal movement of the drawer is releasably restrained in a closed position, wherein said front wall 25 of the drawer 12 abuts against the ends of side walls 16 and 18 of the cabinet 10.

For a clearer understanding thereof, FIG. 6 illustrates the forward free end of the oppositely positioned slide member **30*a* having tab member 52*a*, wherein slide member 30*a* is secured to wall 24** of the drawer.

The invention and its attendant advantages will be understood from the foregoing description and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

We claim:

1. Self-aligning means for sliding drawers and associated slide mechanisms, said slide mechanisms having a plurality of slide members juxtapositioned in parallel arrangement, one above the other, wherein each slide member includes rollers secured thereto, one roller being positioned forwardly of one slide member and a second roller being positioned rearwardly of the second slide member to provide longitudinal movement between each slide member; and wherein each roller is arranged to be operably received within respective slide members thereof, said self-aligning means being characterized by:

frictional engaging means formed in one of said slide members and arranged to indirectly engage said other slide member in a releasable manner to prevent lateral movement of said drawer when said drawer is in a closed position and to provide controlled longitudinal movement of said drawer;

said first slide member being secured to the sides of said drawer for movement therewith, said second slide member being substantially mounted in a stationary manner with respect to said first slide member; and wherein said frictional engaging means is formed adjacent the forward end of said first slide member thereof, whereby said frictional engaging means is arranged to directly releasably engage said roller of said second slide member thereof;

said first slide member including a back wall, and wherein said frictional engaging means comprises an elongated resilient tab member mounted to said back wall thereof adjacent the forward free end of said first slide member, said tab member being bent inwardly thereof for releasable forced engagement with the forward roller of said second slide member thereof; and wherein said tab member is formed as an integral part of said back wall of said first slide member, said tab member being lanced and bent inwardly therefrom.

* * * * *